US010203075B1

(12) United States Patent
Kim

(10) Patent No.: US 10,203,075 B1
(45) Date of Patent: Feb. 12, 2019

(54) BENDABLE LED BAR

(71) Applicant: Janghun Kim, Bucheon-si (KR)

(72) Inventor: Janghun Kim, Bucheon-si (KR)

( * ) Notice: Subject to any disclaimer, the term of this patent is extended or adjusted under 35 U.S.C. 154(b) by 0 days.

(21) Appl. No.: 15/923,042

(22) Filed: Mar. 16, 2018

(30) Foreign Application Priority Data

Jul. 24, 2017 (KR) ..... 10-2017-0093257

(51) Int. Cl.

| | |
|---|---|
| ***F21S 4/00*** | (2016.01) |
| ***H01R 13/62*** | (2006.01) |
| ***F21S 4/28*** | (2016.01) |
| *F21V 23/00* | (2015.01) |
| *F21Y 115/10* | (2016.01) |
| *F21Y 103/10* | (2016.01) |

(52) U.S. Cl.
CPC ..... *F21S 4/28* (2016.01); *F21V 23/001* (2013.01); *F21Y 2103/10* (2016.08); *F21Y 2115/10* (2016.08)

(58) Field of Classification Search
CPC ..... F21S 4/28; F21Y 2103/10; F21V 23/001; H01R 13/62; H01R 16/562
See application file for complete search history.

(56) References Cited

U.S. PATENT DOCUMENTS

2011/0096545 A1* 4/2011 Chang ..... F21V 21/002 362/249.02
2012/0140474 A1* 6/2012 Jurik ..... F21S 2/00 362/249.09
2014/0098535 A1* 4/2014 Smith ..... F21V 5/04 362/238
2014/0362574 A1* 12/2014 Barrett ..... F21S 2/00 362/249.03

FOREIGN PATENT DOCUMENTS

| | | | | |
|---|---|---|---|---|
| EP | 2209165 | A1 * | 7/2010 | ..... F21V 23/06 |
| EP | 3093552 | A1 * | 11/2016 | ..... F21V 23/06 |
| JP | 2010153383 | A * | 7/2010 | ..... H05K 1/142 |
| KR | 20-0448772 | Y1 | 5/2010 | |
| KR | 10-2010-0108917 | A | 10/2010 | |
| KR | 10-2011-0095437 | A | 8/2011 | |
| KR | 10-2012-0137307 | A | 12/2012 | |
| KR | 10-1459699 | B1 | 11/2014 | |

* cited by examiner

*Primary Examiner* — Karabi Guharay
(74) *Attorney, Agent, or Firm* — KORUS Patent, LLC; Seong Il Jeong

(57) ABSTRACT

Disclosed herein is a light-emitting diode (LED) bar which can be desirably bent at various angles in vertical and lateral directions. The bendable LED bar includes: a plurality of LED units each configured such that one or more LEDs are surface-mounted on a rectilinear bar-shaped printed circuit board (PCB) substrate; and one or more bending units electrically connected between the plurality of LED units spaced apart from each other at regular intervals in a front-back direction, and configured to connect the plurality of LED units in a joint fashion so that each of the plurality of LED units can be bent within a predetermined angle. Each of the bending units includes a plurality of rectilinear spring-shaped connection copper lines and a casing mold. The casing mold enables the LED units to be bent in vertical and lateral directions.

5 Claims, 7 Drawing Sheets

BENDABLE LED BAR

BACKGROUND

1. Technical Field

The present invention relates generally to a light-emitting diode (LED) bar which can be desirably bent at various angles in vertical and lateral directions, and more specifically to a bendable LED bar, including: a plurality of LED units each configured such that one or more LEDs are surface-mounted on a rectilinear bar-shaped printed circuit board (PCB) substrate; and one or more bending units electrically connected between the plurality of LED units spaced apart from each other at regular intervals in a front-back direction, and configured to connect the plurality of LED units in a joint fashion so that each of the plurality of LED units can be bent within a predetermined angle; wherein each of the bending units includes a plurality of rectilinear spring-shaped connection copper lines configured to connect the plurality of one-side terminals of a front one of the LED units and the plurality of opposite-side terminals of a subsequent one of the LED units, and a casing mold made of an insulating material and configured such that a plurality of copper line passage holes is formed at regular intervals in a lateral direction and also the plurality of connection copper lines is disposed through the plurality of copper line passage holes, respectively, so that the connection copper lines are prevented from being cut and causing a short circuit; and wherein the casing mold enables the LED units to be bent in vertical and lateral directions in such a manner that the connection copper lines are selectively extended and contracted through the open front and back ends of the copper line passage holes in a lengthwise direction.

2. Description of the Related Art

In general, light-emitting diodes (LEDs) have low power consumption, have high efficiency, and are lightweight. Accordingly, LEDs are being widely used in various fields, including various types of signboards, traffic lights, bus and tax guide plates, landscape lighting lamps, etc. Recently, in order to increase the usability of LEDs, a plurality of LEDs is surface-mounted on a flexible printed circuit board (FPCB) made of a flexible synthetic resin material, and the LEDs are applied to a curved surface having a predetermined curvature.

Conventionally, a flexible LED bar in which a plurality of LEDs is mounted on a rectilinear flexible circuit board is manufactured using such an FPCB, the flexible LED bar is attached to a target object having a predetermined curved surface, and then lighting is provided.

As a conventional technology regarding the above-described flexible LED bar, Korean Registered Utility Model No. 20-0448772 discloses an LED bar which is fabricated in a bar shape by attaching LED chips to a PCB in a single line or a plurality of lines, and elasticity is imparted to the PCB by forming a plurality of depressions in both side portions of the PCB of the LED bar in a crossed manner, so that the LED bar can be bent in a widthwise direction, thereby LED chips to be disposed on a plane in a circular or curved form without requiring separate welding work.

However, the conventional technology is problematic in that when the LED bar is bent at an angle equal to or larger than a predetermined angle in a widthwise direction, the bent portion of the PCB is bent or curved in a vertical direction and thus protrudes in the vertical direction, so that the LED bar is separated from an attachment surface and thus the LED bar is not desirably attached to a target object and is easily removed from the target object. In particular, when the conventional technology is applied to an RGB-type LED bar having a large width, the LED bar can be stably attached only when the LED bar is used for the case of being bent at an angle equal to or lower than 45°. In contrast, when the LED bar is used for the case of being bent at an angle larger than 45°, a bent portion is excessively curved and protrudes, and thus a problem arises in that it is difficult to apply the LED bar. Furthermore, when a plurality of depressions is deeply formed in the PCB, a problem arises in that the width of the PCB is excessively decreased and thus the PCB is easily broken or cut.

Moreover, the conventional technology is problematic in that the conventional technology cannot be applied to a PCB made of a rigid material because the PCB is formed of an FPCB which can be flexibly bent, and is also problematic in that a product cost is expensive because an expensive FPCB is employed.

SUMMARY

The present invention has been conceived to overcome the above-described problems, and an object of the present invention is to provide a bendable LED bar, in which a plurality of short rectilinear bar-shaped LED units is spaced apart from each other at regular intervals in a front-back direction, and one or more bending units are electrically connected between the plurality of LED units, thereby enabling the LED units to be bent around the bending units, in which a plurality of one-side terminal provided in a front LED unit and a plurality of opposite-side terminals provided in a subsequent LED unit are electrically connected via connection copper lines, the plurality of connection copper lines is horizontally disposed through the casing mold in a front-back direction, and the coil spring-shaped connection copper lines are selectively extended and contracted in a lengthwise direction through the open front and back ends of the copper line passage holes of the casing mold, thereby enabling the plurality of LED units to be stably bent within a predetermined angle in vertical and lateral directions via the bending units, and in which the plurality of connection copper lines is maintained inside the casing mold in a partitioned state, thereby preventing the connection copper lines from being cut and causing a short circuit during a process of being bent.

In order to accomplish the above object, the present invention provides a bendable LED bar, including: a plurality of LED units each configured such that one or more LEDs are surface-mounted on a rectilinear bar-shaped PCB; and one or more bending units electrically connected between the plurality of LED units spaced apart from each other at regular intervals in a front-back direction, and configured to connect the plurality of LED units in a joint fashion so that each of the plurality of LED units is bendable within a predetermined angle; wherein each of the bending units includes: a plurality of connection copper lines configured to connect the plurality of one-side terminals of a front one of the LED units and the plurality of opposite-side terminals of a subsequent one of the LED units; and a casing mold made of an insulating material, and configured such that a plurality of copper line passage holes is formed at regular intervals in a lateral direction and also the plurality of connection copper lines is disposed through the plurality of copper line passage holes, respectively, so that the connection copper lines are prevented from being cut and causing a short circuit; and wherein the casing mold enables the LED units to be bent in vertical and lateral directions in such a manner that the connection copper lines are selectively extended and contracted through open front and back ends of the copper line passage holes in a lengthwise direction, the casing mold is configured such that the bottoms of the copper line passage holes are open such that the connection copper lines are fitted into the casing mold through the open bottoms, and fastening protrusions protrude inward from the lower portions of the left and right sides of the inner circumferential surface of each of the copper line passage holes of the casing mold so that the lower portions of the left and right sides of the outer circumferential surface of each of the connection copper lines are fastened by the fastening protrusions.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
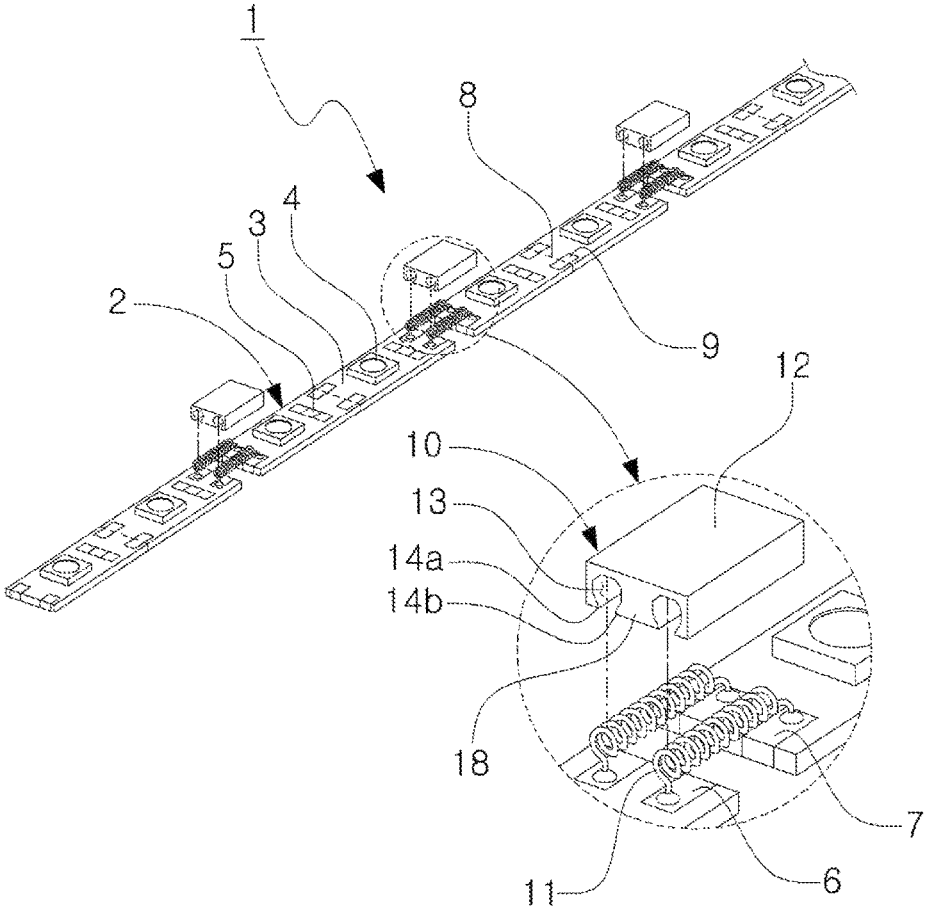
FIG. 1 is a schematic perspective view showing a bendable LED bar according to the present invention with the connection copper lines and casing molds of bending units separated from each other.

Preferred embodiments according to the present invention will be described in detail below with reference to the accompanying drawings.

As shown in FIGS. 1 to 7, a bendable LED bar 1 according to the present invention is an LED bar which can be desirably bent at various angles in vertical and lateral directions. The bendable LED bar 1 includes: a plurality of LED units 2 each configured such that one or more LEDs 4 are surface-mounted on a rectilinear bar-shaped PCB 3; and one or more bending units 10 electrically connected between the plurality of LED units 2 spaced apart from each other at regular intervals in a front-back direction, and configured to connect the plurality of LED units 2 in a joint fashion, thereby enabling each of the plurality of LED units 2 to be bent within a predetermined angle.

As shown in FIGS. 1 to 5, the plurality of LED units 2 is each configured such that one or more LEDs 4 are surface-mounted on a short rectilinear bar-shaped PCB 3 at regular intervals. The plurality of LED units 2 is spaced apart from each other at regular intervals in a front-back direction, and the bending units 10 are disposed between and connect the plurality of LED units 2. Accordingly, the LED units 2 are desirably bent within a predetermined angle in vertical and lateral directions around the bending units 10.

Each of the LED units 2 is configured such that one or more LEDs 4 and resistors 5 are mounted on a bar-shaped PCB 3 made of a rigid or flexible PCB material, and a plurality of one-side terminals 6, i.e., a positive electrode (+) and a negative electrode (−), or ground electrodes, and a plurality of opposite-side terminals 7, i.e., a positive electrode (+) and a negative electrode (−), or ground electrodes, are formed at regular intervals in lateral directions at front and rear ends. Accordingly, other LED units 2, other circuit units (not shown), power lines, or the like can be electrically connected via the plurality of one-side terminals 6 and the plurality of opposite-side terminals 7.

Meanwhile, the LED unit 2 is configured to include three or more one-side terminals 6 and three or more opposite-side terminals 7 when LEDs 4 are installed in an RGB form.

Furthermore, in the LED unit 2, a cutoff line 8 is formed on the PCB 3 in a widthwise direction, and thus the LED unit 2 is separated and cut. A plurality of dividable terminals 9 is formed on a portion where the cutoff line 8 is formed. Accordingly, when the LED unit 2 is separated and cut along the cutoff line 8, each of the dividable terminals 9 is cut into haves and forms one-side terminal 6 and the opposite-side terminal 7.

As shown in FIGS. 1 to 7, each of the bending units 10 is installed between and connects corresponding two of the LED units 2, and enables the two LED units 2 to be bent within a predetermined angle. The bending units 10 are electrically connected between the plurality of LED units 2 spaced apart from each other at regular intervals in a front-back direction, and connect the plurality of LED units 2 in a joint fashion, thereby enabling each of them to be bent within a predetermined angle. Each of the bending units 10 includes: a plurality of rectilinear coil spring-shaped connection copper lines 11 configured to connect a plurality of one-side terminals 6 formed on a front LED unit 2 with a plurality of opposite-side terminals 7 formed on a subsequent LED unit 2 in a front-back direction; and a casing mold 12 made of an insulating material, and configured such that a plurality of copper line passage holes 13 are formed therethrough at regular intervals in a lateral direction so that the connection copper lines 11 are placed inside the plurality of copper line passage holes 13, thereby preventing the connection copper lines 11 from being cut and causing a short circuit.

The plurality of connection copper lines 11 is formed in rectilinear coil spring shapes, and electrically connects the plurality of LED units 2 spaced apart from each other at regular intervals in a front-back direction. The front and back ends of the connection copper lines 11 are welded on and electrically connect the plurality of one-side terminals 6 of the front LED unit 2 and the plurality of opposite-side terminals 7 of the subsequent LED unit 2, which act as a positive electrode (+) and a negative electrode (−), ground electrodes, or the like.

Figure 4:
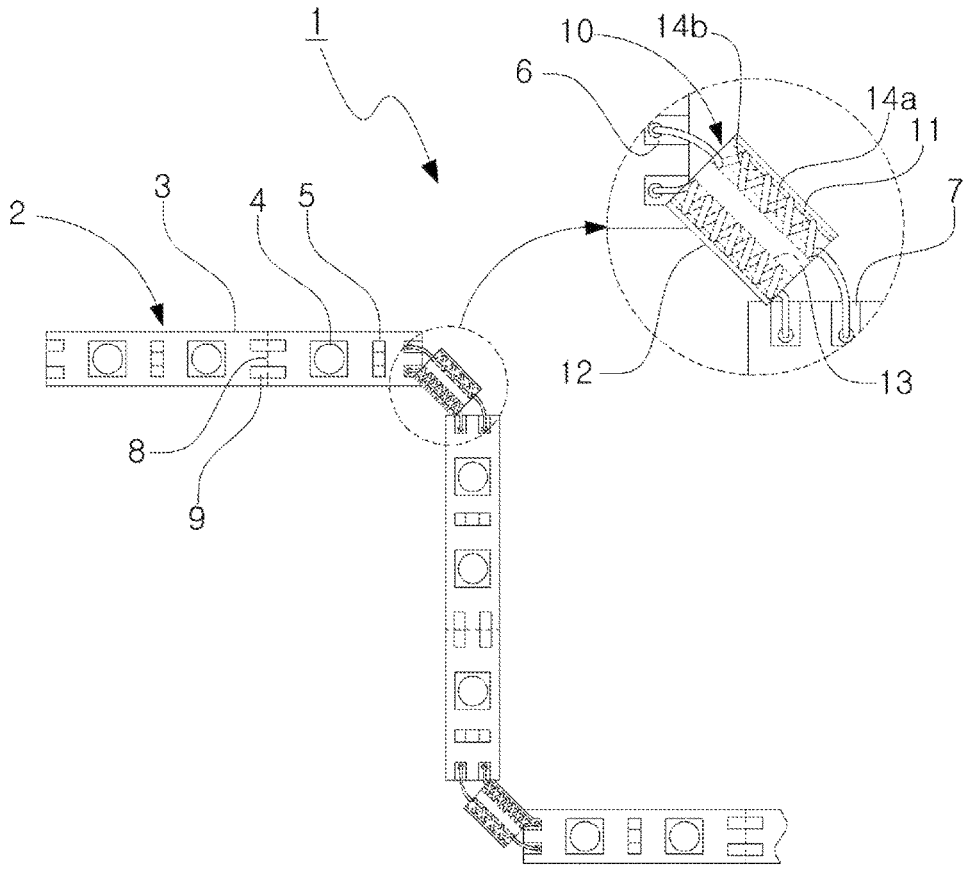
FIG. 4 is a schematic plan view showing the state in which the LED units of the bendable LED bar according to the present invention have been bent via bending units.

As described above, the front and subsequent LED units 2 are connected by the plurality of connection copper lines 11 formed in coil spring shapes. As shown in FIG. 4, when the plurality of LED units 2 is each bent within a predetermined angle, the plurality of connection copper lines 11 is desirably bent while being selectively extended and contracted in a lengthwise direction. In the state in which the plurality of LED units 2 has been bent at an angle equal to or larger than 90°, the plurality of connection copper lines 11 is prevented from protruding in a vertical direction or being bent by the casing mold 12, and thus the plurality of LED units 2 is stably installed in the state of having come into tight contact with an attachment surface.

Figure 6:
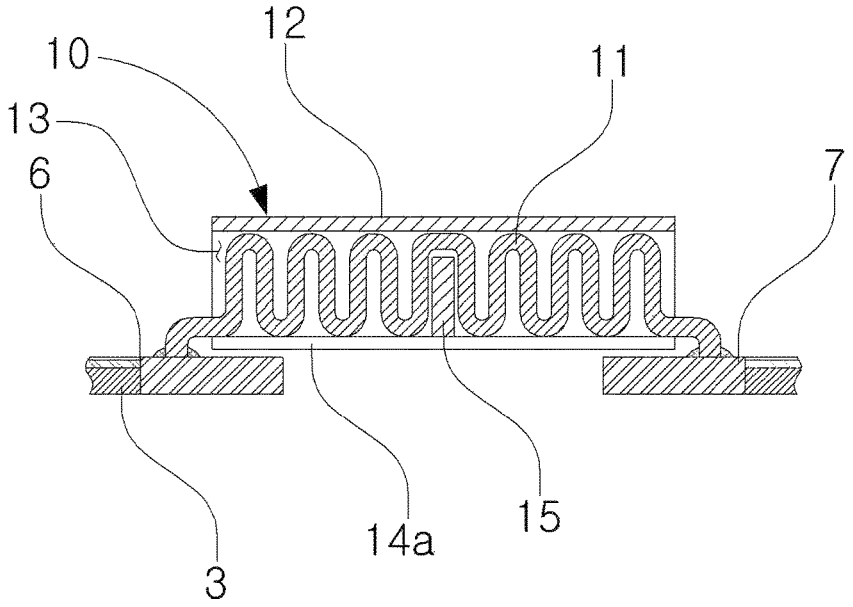
FIG. 6 is a schematic sectional view showing another type of connection copper line provided in a bending unit of the bendable LED bar according to the present invention.

Meanwhile, as shown in FIG. 6, the plurality of connection copper lines 11 is formed in rectilinear line shapes in which the plurality of connection copper lines 11 is successively bent. When the plurality of LED units 2 is bent, the plurality of connection copper lines 11 is desirably bent while being selectively extended and contracted in a lengthwise direction.

The casing mold 12 is made of an insulating synthetic resin material, such as plastic or the like. In the casing mold 12, a plurality of rectilinear line-shaped copper line passage holes 13 is formed at regular intervals in a lateral direction, and is open at the front and back ends thereof and on the bottom thereof. The connection copper lines 11 are fitted into the rectilinear line-shaped copper line passage holes 13 through the open bottom of the casting mold 12, and the front and back portions of the connection copper lines 11 fitted into the respective copper line passage holes 13 enable the LED units 2 to be stably bent in vertical and lateral directions while being selectively extended and contracted in a lengthwise direction through the open front and back ends of the copper line passage holes 13.

Furthermore, the casing mold 12 prevents the plurality of connection copper lines 11 from coming into contact with each other in order to prevent a short circuit by means of a partition 18 formed between the plurality of copper line passage holes 13 during a process in which the plurality of connection copper lines 11 is bent or is selectively extended and contracted in a lengthwise direction.

Furthermore, in the casing mold 12, fastening protrusions 14*a* and 14*b* protrude inward from the lower portions of the left and right sides of the inner circumferential surface of each of the copper line passage holes 13. The lower portions of the left and right sides of the outer circumferential surface of each of the connection copper lines 11 are fastened by the fastening protrusions 14*a* and 14*b* formed on the left and right sides of the inside of a corresponding one of the copper line passage holes 13. Accordingly, the connection copper line 11 is prevented from being removed through the open bottom of the copper line passage hole 13 during a process in which the connection copper line 11 is bent in vertical and lateral directions or is selectively extended and contracted in a lengthwise direction. In this case, when the connection copper line 11 is inserted into the copper line passage hole 13 of the casing mold 12, the connection copper line 11 is inserted into the copper line passage hole 13 without interference with the fastening protrusions 14*a* and 14*b* by increasing the gap of the open bottom of the casing mold 12, made of a synthetic resin material, to the left and right sides.

Figure 5:
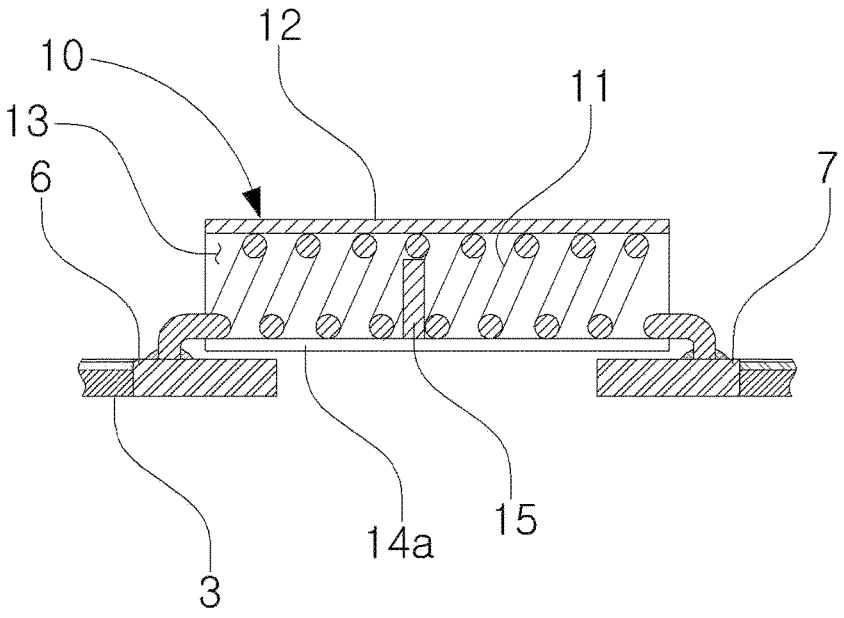
FIG. 5 is a schematic sectional view showing the portion where a bending unit of the bendable LED bar according to the present invention is installed.

Meanwhile, as shown in FIGS. 5 and 6, in the casing mold 12, a separation prevention member 15 is fitted into the center portion of the inside of each of the copper line passage holes 13 while traversing the center portion in a lateral direction. The separation prevention member 15 is fitted into the copper line passage hole 13 through the open bottom of the copper line passage hole 13, and then the upper end of the separation prevention member 15 comes into contact with the center portion of the connection copper line 11 disposed in the inside of the copper line passage hole 13. In this state, the separation prevention member 15 prevents the connection copper line 11 from being moved, and also prevents the connection copper line 11 from being separated through the open bottom of the casing mold 12 during a process in which the connection copper line 11 is bent in vertical and lateral directions or is selectively extended and contracted in a lengthwise direction.

Figure 7:
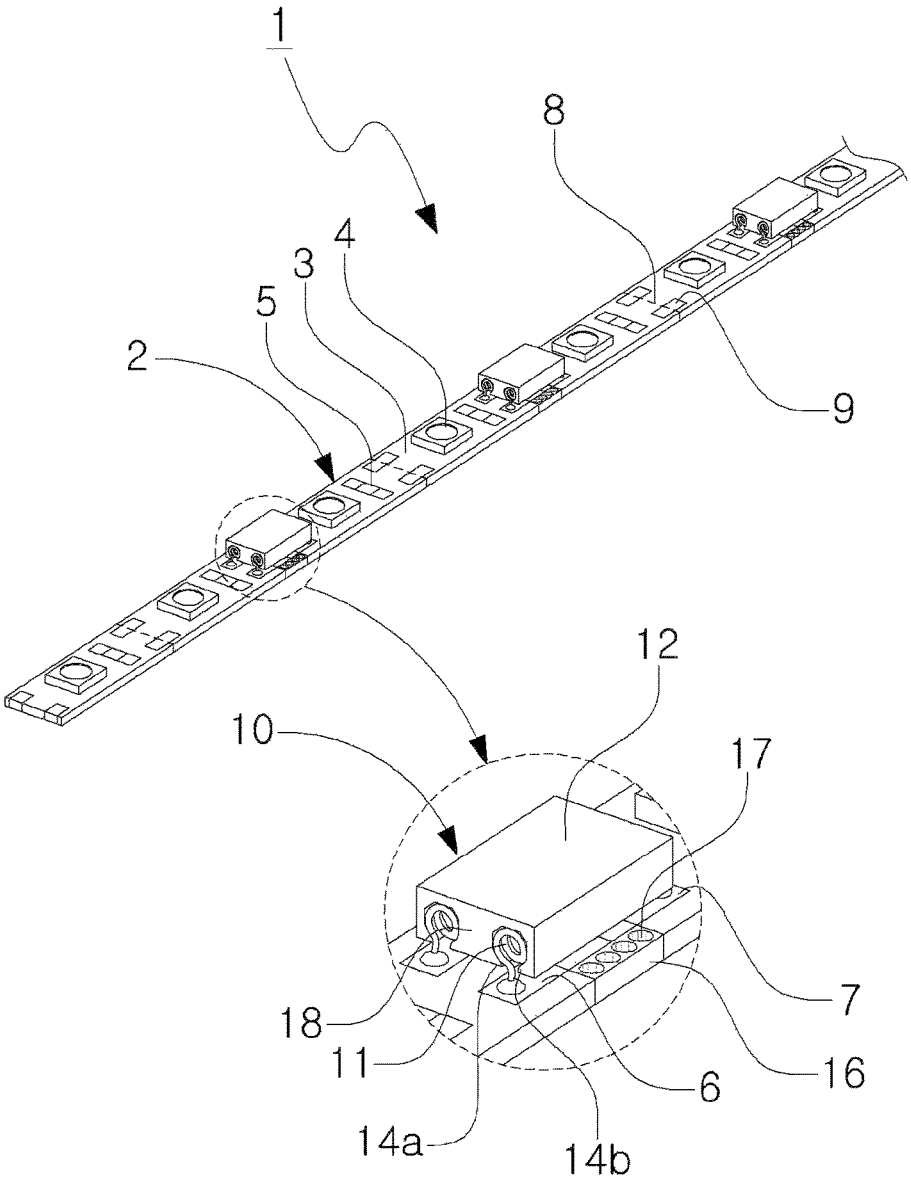
FIG. 7 is a schematic perspective view showing the state in which the left and right sides of the front and subsequent LED units of the bendable LED bar according to the present invention have been connected via a cutoff portion.

Furthermore, as shown in FIG. 7, a plurality of LED units 2 according to the present invention is configured such that the right side of the PCB 3 of a front LED unit 2 and the left side of the PCB 3 of a subsequent LED unit 2 are integrated with each other through a cutoff portion 16 in a front-back direction. The cutoff portion 16 is made of the same material as the PCBs 3. A plurality of cutoff holes 17 is formed through the cutoff portion 16 at regular intervals in a front-back direction. Accordingly, the thickness of the portion of the cutoff portion where the cutoff holes 17 are formed is small, and thus the portion of the cutoff portion is easily broken. As a result, a user can conveniently break only a cutoff portion 16 corresponding to a portion which will be bent within a predetermined angle, and thus the front and subsequent LED units 2 are separated from each other. Thereafter, the front and subsequent LED units 2 can be each bent within a predetermined angle via a bending unit 10 which connects the front and subsequent LED units 2.

Figure 2:
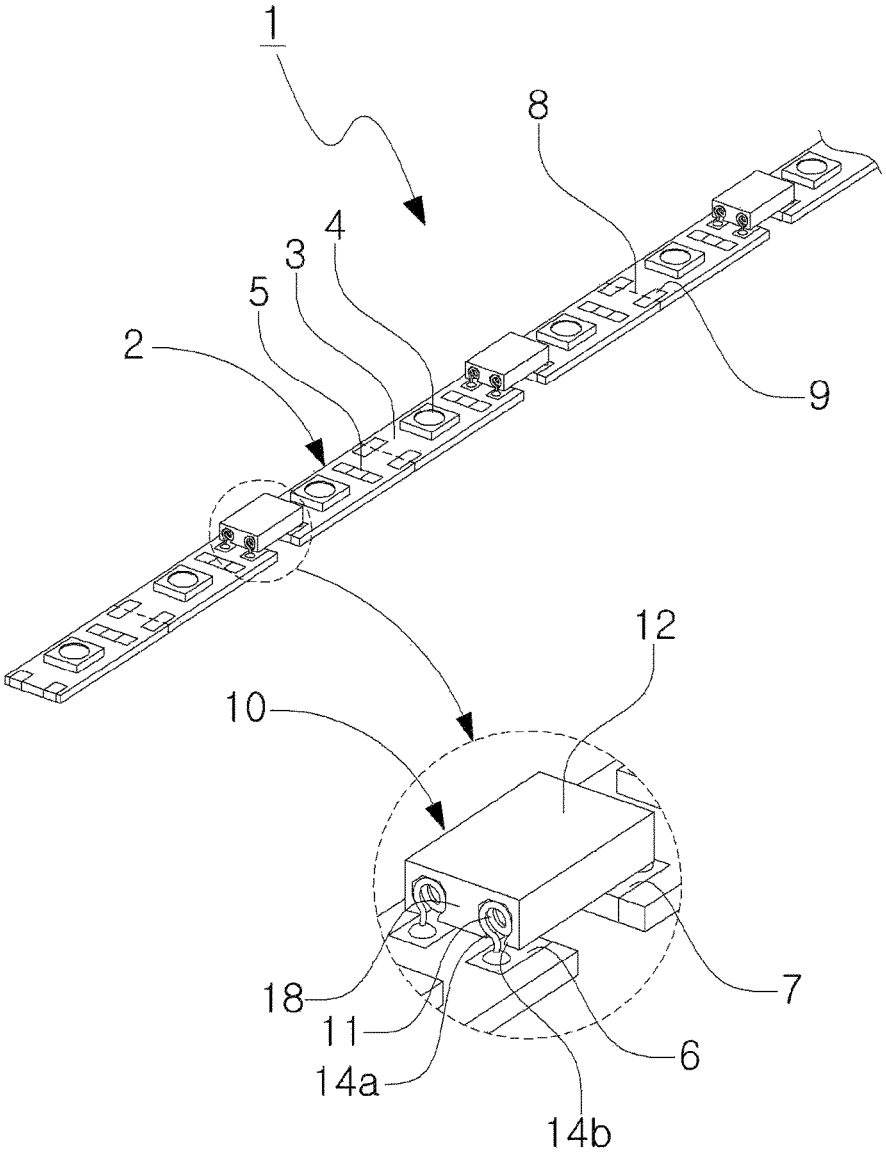
FIG. 2 is a schematic perspective view showing the bendable LED bar according to the present invention with the connection copper lines and casing molds of bending units coupled to each other.
Figure 3:
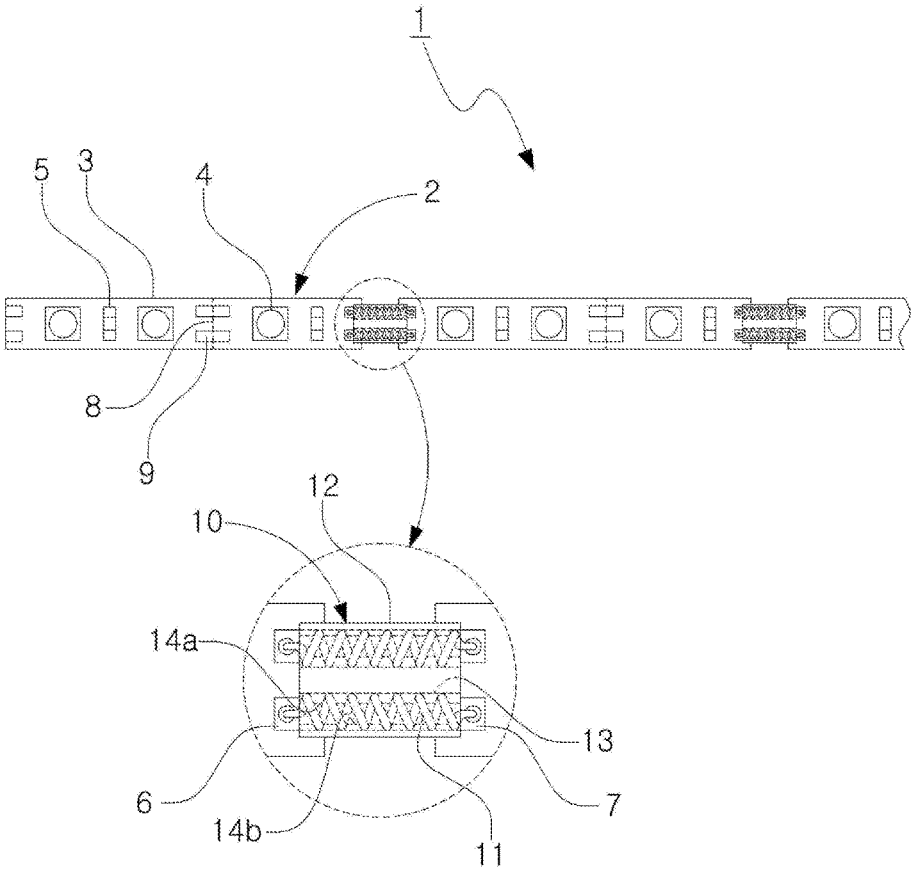
FIG. 3 is a schematic plan view showing the bendable LED bar according to the present invention.

The operation of the present invention is as follows:

When the bendable LED bar 1 according to the present invention is installed on an attachment surface including a curved portion in the state of being bent at a predetermined angle, the bendable LED bar 1 is bent at an angle suitable for the curved portion by bending the bending units 10 installed between the plurality of LED units 2 spaced apart from each other at regular intervals, as shown in FIGS. 2 and 3 in a front-back direction. In other words, when any one of the front LED unit 2 and the subsequent LED unit 2 located in a line in a front-back direction is bent in a widthwise direction, as shown in FIG. 4, the front and back sides of the plurality of coil spring-shaped connection copper lines 11 which connect the plurality of one-side terminals 6 of the front LED unit 2 and the plurality of opposite-side terminals 7 of the subsequent LED unit 2 are selectively extended and contracted out of and into the copper line passage holes 13 of the casing mold 12. Accordingly, the front or subsequent LED unit 2 is desirably bent at a predetermined angle in vertical and lateral directions. Even in the state in which the plurality of LED units 2 has been bent at an angle equal to or larger than 90°, the plurality of connection copper lines 11 is prevented from protruding in a vertical direction or being bent by the casing mold 12, and thus the plurality of LED units 2 is stably installed in the state of being in tight contact with an attachment surface including a curved portion.

Furthermore, the connection copper lines 11 are prevented from causing a short circuit or being cut by the partition 18 of the casing mold 12 because the connection copper lines 11 do not come into contact with each other during a process in which the plurality of connection copper line 11 is bent or selectively extended and contacted in a lengthwise direction. The lower portions of the left and right sides of the outer circumferential surfaces of the connection copper lines 11 disposed through the respective copper line passage holes 13 are fastened by the fastening protrusions 14*a* and 14*b* of the casing mold 12, and thus the connection copper lines 11 are maintained in a stable installation state without being separated through the open bottoms of the copper line passage holes 13 during a process in which the connection copper lines 11 are bent in vertical and lateral directions or selectively extended and contacted in a lengthwise direction.

According to the above-described present invention, there is provided the bendable LED bar, in which the plurality of short rectilinear bar-shaped LED units is spaced apart from each other at regular intervals in a front-back direction, and the one or more bending units are electrically connected between the plurality of LED units, thereby enabling the LED units to be bent around the bending units, in which the plurality of one-side terminal provided in the front LED unit and the plurality of opposite-side terminals provided in the subsequent LED unit are electrically connected via the connection copper lines, the plurality of connection copper lines is horizontally disposed through the casing mold in a front-back direction, and the coil spring-shaped connection copper lines are selectively extended and contracted in a lengthwise direction through the open front and back ends of the copper line passage holes of the casing mold, thereby enabling the plurality of LED units to be stably bent within a predetermined angle in vertical and lateral directions via the bending units, and in which the plurality of connection copper lines is maintained inside the casing mold in a partitioned state, thereby preventing the connection copper lines from being cut and causing a short circuit during a process of being bent.

Although the specific embodiments of the present invention have been disclosed for illustrative purposes, those skilled in the art will appreciate that various modifications, additions and substitutions are possible without departing from the scope and spirit of the invention as disclosed in the accompanying claims.

What is claimed is:

1. A bendable light-emitting diode (LED) bar, comprising:

a plurality of LED units each configured such that one or more LEDs are surface-mounted on a rectilinear bar-shaped printed circuit board (PCB) substrate; and one or more bending units electrically connected between the plurality of LED units spaced apart from each other at regular intervals in a front-back direction, and configured to connect the plurality of LED units in a joint fashion so that each of the plurality of LED units is bendable within a predetermined angle;

wherein each of the bending units comprises: a plurality of connection copper lines configured to connect a plurality of one-side terminals of a front one of the LED units and a plurality of opposite-side terminals of a subsequent one of the LED units; and a casing mold made of an insulating material, and configured such that a plurality of copper line passage holes is formed at regular intervals in a lateral direction and also the plurality of connection copper lines is disposed through the plurality of copper line passage holes, respectively, so that the connection copper lines are prevented from being cut and causing a short circuit; and wherein the casing mold enables the LED units to be bent in vertical and lateral directions in such a manner that the connection copper lines are selectively extended and contracted through open front and back ends of the copper line passage holes in a lengthwise direction, the casing mold is configured such that bottoms of the copper line passage holes are open such that the connection copper lines are fitted into the casing mold through the open bottoms, and fastening protrusions protrude inward from lower portions of left and right sides of an inner circumferential surface of each of the copper line passage holes of the casing mold so that lower portions of left and right sides of an outer circumferential surface of each of the connection copper lines are fastened by the fastening protrusions.

2. The bendable LED bar of claim 1, wherein the plurality of connection copper lines is formed in rectilinear coil spring shapes.

3. The bendable LED bar of claim 1, wherein the plurality of connection copper lines is formed in rectilinear successively bent shapes.

4. The bendable LED bar of claim 1, wherein at least one separation prevention member is fitted into a center portion of an inside of each of the copper line passage holes of the casing mold while traversing the center portion in a lateral direction, and an upper end of the separation prevention member comes into contact with a center portion of a connection copper line disposed through the copper line passage hole so that the connection copper line is prevented from being moved.

5. The bendable LED bar of claim 1, wherein left and right sides of a PCB of the front one of the plurality of LED units and a PCB of the subsequent one of the plurality of LED units are integrated with each other via a cutoff portion in a front-back direction, the cutoff portion is made of a material identical to that of the PCBs, and a plurality of cutoff holes is formed through the cutoff portion at regular intervals in a front-back direction so that the front and subsequent LED units are separated from each other in such a manner that a user breaks the cutoff portion corresponding to a portion which will be bent within a predetermined angle.

* * * * *